US008727710B2

(12) United States Patent
Propheter-Hinckley et al.

(10) Patent No.: US 8,727,710 B2
(45) Date of Patent: May 20, 2014

(54) MATEFACE COOLING FEATHER SEAL ASSEMBLY

(75) Inventors: Tracy A. Propheter-Hinckley, Manchester, CT (US); Stephanie Santoro, Bristol, CT (US); Evan Petrakis, W. Haven, CT (US)

(73) Assignee: United Technologies Corporation, Hartford, CT (US)

( * ) Notice: Subject to any disclaimer, the term of this patent is extended or adjusted under 35 U.S.C. 154(b) by 555 days.

(21) Appl. No.: 13/012,025

(22) Filed: Jan. 24, 2011

(65) Prior Publication Data

US 2012/0189424 A1 Jul. 26, 2012

(51) Int. Cl.
*F01D 5/00* (2006.01)

(52) U.S. Cl.
USPC ..... 415/139

(58) Field of Classification Search
USPC ..... 415/115, 110, 170.1, 173.3, 174.2, 103, 415/173.1; 277/641, 644, 650
See application file for complete search history.

(56) References Cited

U.S. PATENT DOCUMENTS

| | | | | |
|---|---|---|---|---|
| 2,510,645 | A * | 6/1950 | McMahan | 60/796 |
| 4,524,980 | A | 6/1985 | Lillibridge et al. | |
| 4,767,260 | A * | 8/1988 | Clevenger et al. | 415/115 |
| 5,709,530 | A * | 1/1998 | Cahill et al. | 415/170.1 |
| 6,179,560 | B1 | 1/2001 | Kouris et al. | |
| 6,494,044 | B1 * | 12/2002 | Bland | 60/772 |
| 6,681,578 | B1 * | 1/2004 | Bunker | 60/772 |
| 7,316,402 | B2 | 1/2008 | Paauwe | |
| 2006/0255549 | A1 | 11/2006 | Amos et al. | |
| 2009/0092485 | A1 | 4/2009 | Bridges, Jr. et al. | |
| 2009/0116953 | A1 | 5/2009 | Spangler et al. | |
| 2009/0191050 | A1 | 7/2009 | Nereim et al. | |

* cited by examiner

*Primary Examiner* — Nathaniel Wiehe
*Assistant Examiner* — Eldon Brockman
(74) *Attorney, Agent, or Firm* — Carlson, Gaskey & Olds, PC

(57) ABSTRACT

A feather seal assembly includes a seal having a directional passage to direct an airflow generally non-perpendicular to the seal.

12 Claims, 6 Drawing Sheets

MATEFACE COOLING FEATHER SEAL ASSEMBLY

STATEMENT REGARDING FEDERALLY SPONSORED RESEARCH OR DEVELOPMENT

The government may have certain rights to this invention pursuant to Contract No. N00019-02-C-303 awarded by the United States Navy.

BACKGROUND

The present disclosure relates to gas turbine engines, and in particular, to a feather seal assembly.

Feather seals are commonly utilized in aerospace and other industries to provide a seal between two adjacent components. For example, gas turbine engine vanes are arranged in a circumferential configuration to form an annular vane ring structure about a center axis of the engine. Typically, each stator segment includes an airfoil and a platform section. When assembled, the platforms abut and define a radially inner and radially outer boundary to receive hot gas core airflow.

Typically, the edge of each platform includes a channel which receives a feather seal assembly that seals the hot gas core airflow from a surrounding medium such as a cooling airflow. Feather seals are often typical of the first stage of a high pressure turbine in a twin spool engine.

Feather seals may also be an assembly of seals joined together through a welded tab and slot geometry which may be relatively expensive and complicated to manufacture.

SUMMARY

A feather seal assembly according to an exemplary aspect of the present disclosure includes a seal having a directional passage to direct an airflow generally non-perpendicular to said seal.

A feather seal assembly according to an exemplary aspect of the present disclosure includes an axial seal having a directional passage and a raised feature and a radial seal mounted to said axial seal between the directional passage and the raised feature A method of cooling a mate-face area between stator segments of an annular vane ring structure within a gas turbine engine according to an exemplary aspect of the present disclosure includes directing an airflow generally non-perpendicular to an axial seal of a feather seal assembly located between a first stator segment and a second stator segment.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
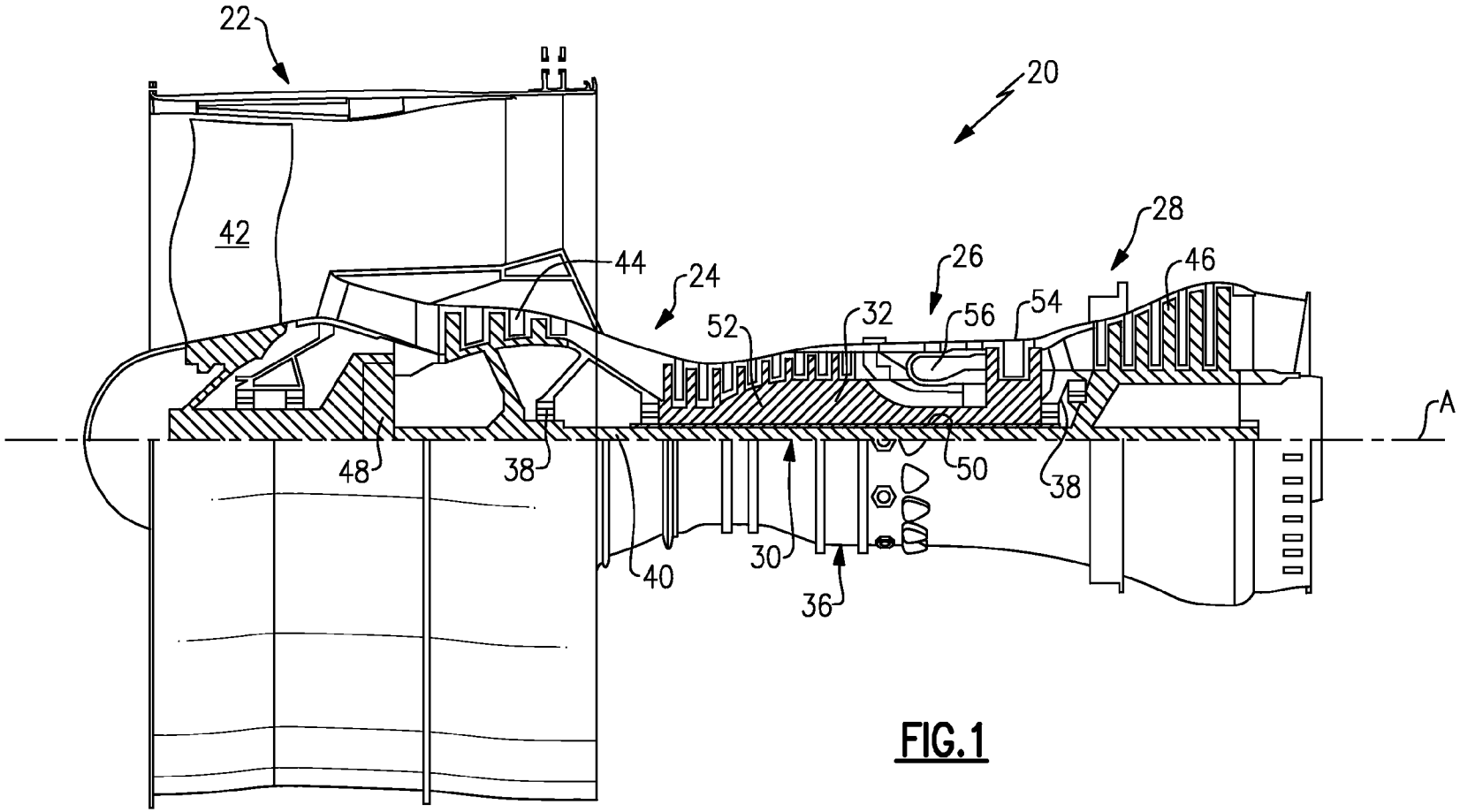
FIG. 1 is a schematic cross-sectional view of a gas turbine engine.

FIG. 1 schematically illustrates a gas turbine engine 20. The gas turbine engine 20 is disclosed herein as two-spool turbofan that generally incorporates a fan section 22, a compressor section 24, a combustor section 26 and a turbine section 28. Alternative engines might include an augmentor section (not shown) among other systems or features. The fan section 22 drives air along a bypass flowpath while the compressor section 24 drives air along a core flowpath for compression and communication into the combustor section. Although depicted as a turbofan gas turbine engine in the disclosed non-limiting embodiment, it should be understood that the concepts described herein are not limited to use with turbofans as the teachings can be applied to other types of turbine engines.

The engine 20 generally includes a low speed spool 30 and high speed spool 32 mounted for rotation about an engine central longitudinal axis A relative to an engine static structure 36 via several bearing systems 38. The low speed spool 30 generally includes an inner shaft 40 that interconnects a fan 42, a low pressure compressor 44 and a low pressure turbine 46. The inner shaft 40 may drive the fan 42 either directly or through a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged between the high pressure compressor 52 and the high pressure turbine 54. The inner shaft 40 and the outer shaft 50 are concentric and rotate about the engine central longitudinal axis A which is collinear with their longitudinal axes.

Core airflow is compressed by the low pressure compressor 44 then the high pressure compressor 52, mixed and burned with the fuel in the combustor 56, then expanded over the high pressure turbine 54 and low pressure turbine 46. The turbines 54, 46 rotationally drive the respective low speed spool 30 and high speed spool 32 in response to the expansion.

Figure 2:
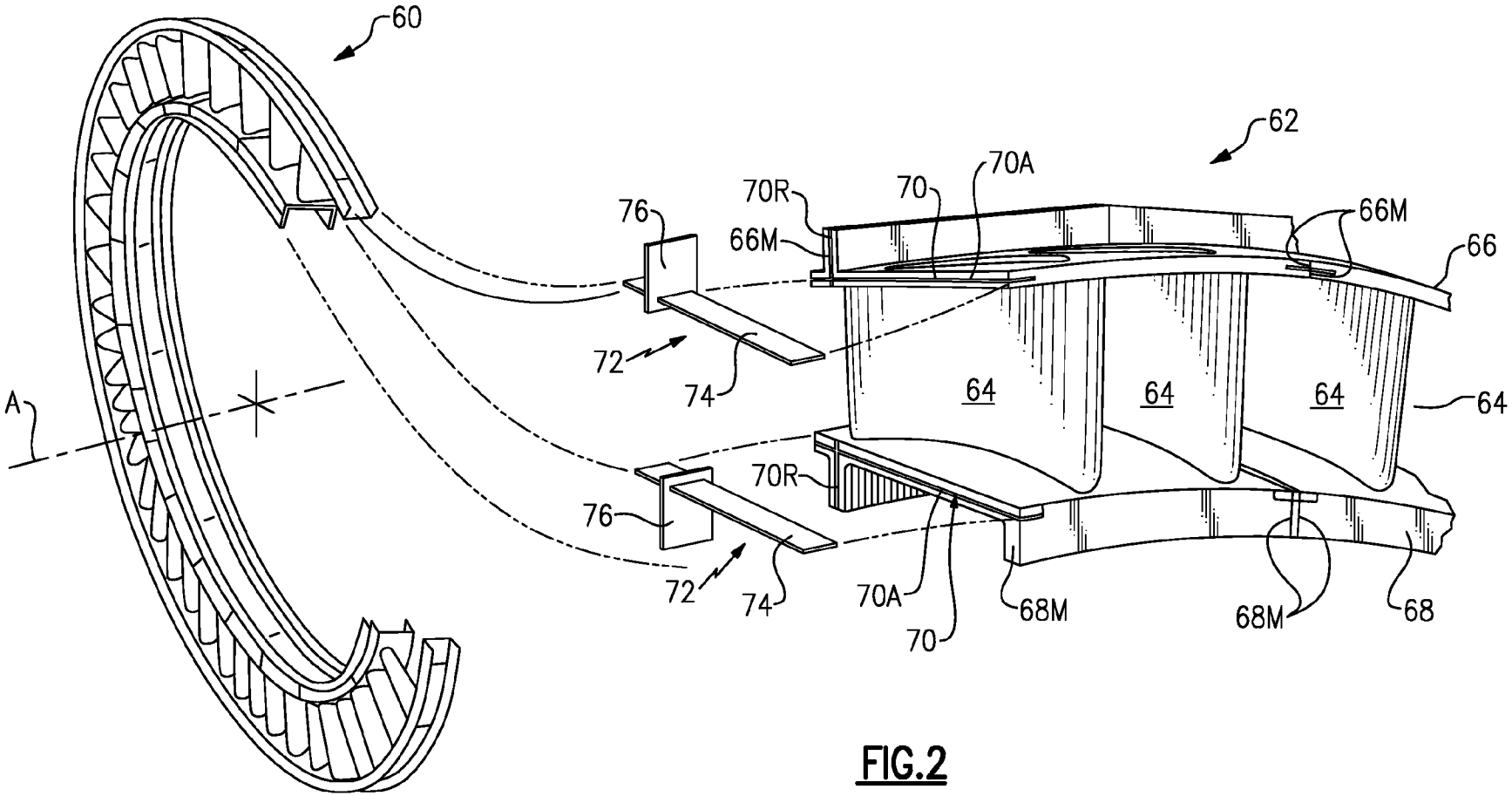
FIG. 2 is an exploded view of an annular stator vane structure of a turbine section defined by a multiple of stator segments with a feather seal assembly therebetween.

With reference to FIG. 2, an annular nozzle 60 within the turbine section 28 is defined by a multiple of stator segments 62. Although a turbine nozzle is illustrated in the disclosed non-limiting embodiment, it should be understood that other engine sections will also benefit herefrom. Each stator segment 62 may include one or more circumferentially spaced airfoils 64 which extend radially between an outer platform 66 and an inner platform 68 radially spaced apart from each other. The arcuate outer platform 66 may form a portion of the engine static structure and the arcuate inner platform 68 may form a portion of the engine static structure to at least partially define the annular turbine nozzle for the hot gas core air flow path.

Each circumferentially adjacent platform 66, 68 thermally uncouple each adjacent stator segment 62. That is, the temperature environment of the turbine section 28 and the substantial aerodynamic and thermal loads are accommodated by the plurality of circumferentially adjoining stator segments 62 which collectively form the full, annular ring about the centerline axis A of the engine.

To seal between each adjacent stator segment 62, each platform 66, 68 includes a slot 70 in a mate-face 66M, 68M to receive a feather seal assembly 72. That is, the plurality of stator segments 62 are abutted at the mate-faces 66M, 68M to form the complete ring. Each slot 70 generally includes an axial segment 70A and a radial segment 70R transverse thereto which receives an axial seal 74 and a radial seal 76 of the feather seal assembly 72. It should be understood that the feather seal assembly 72 may be located in either or both platforms 66, 68.

Figure 3:
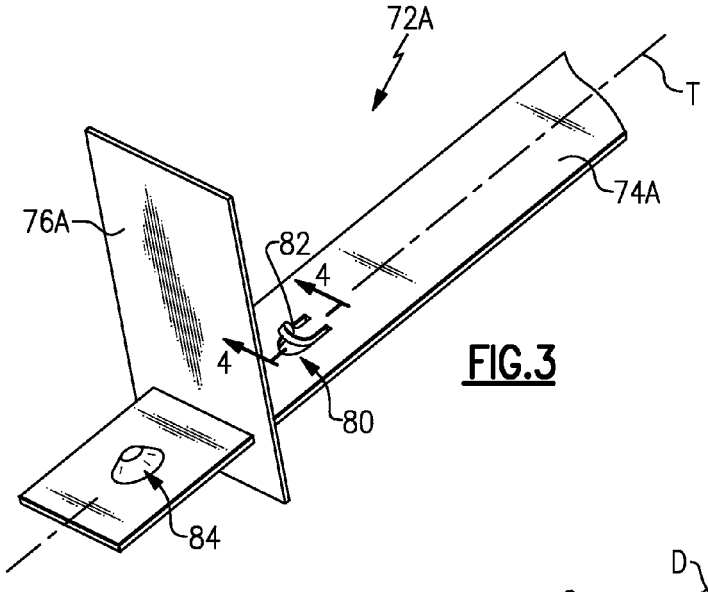
FIG. 3 is an enlarged perspective view of one non-limiting embodiment of a feather seal assembly.
Figure 4:
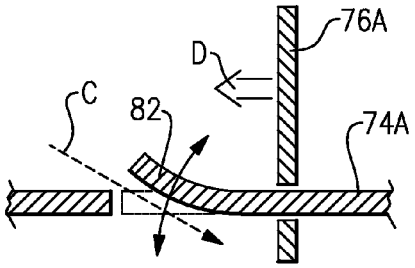
FIG. 4 is a sectional view of taken along line 4-4 in FIG. 3.

With reference to FIG. 3, one non-limiting embodiment of a feather seal assembly 72A includes a directional passage 80 (also illustrated in FIG. 4) within the axial seal 74A. It should be understood that although the directional passage 80 is illustrated in the disclosed embodiment as in the axial seal 74A, the directional passage may alternatively or additionally be located in the radial seal 76A. The directional passage 80 includes a tab 82 cut along a longitudinal axis T of the axial seal 74A. The directional passage 80 permits passage of a radial seal 76A thereover in a single direction through flexing of the tab 82 (FIG. 4). That is, the radial seal 76A may pass over in a single direction (arrow D) to permit assembly without welding to simplify assembly. The radial seal 76A is thereby trapped between the tab 82 and a raised feature 84 in the axial seal 74A without a weld. The raised feature 84 may be, for example, a weld buildup, a dimple formed in the axial seal 74A or other feature. It should be understood that in some assemblies, the radial seal 76A need not be welded to the axial seal 74A as proper positioning is provided by slot 70. That is, the feather seal assembly 72A need only remain an assembly to facilitate installation.

Figure 5:
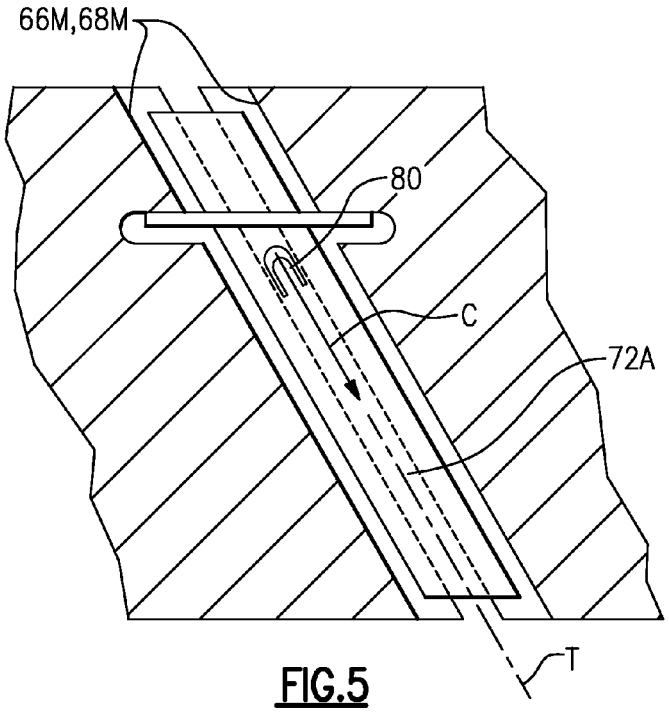
FIG. 5 is a bottom view of the feather seal assembly of FIG. 3 illustrating a cooling flow path therethrough.

The tab 82 also facilitates the direction of airflow C that enters the slot 70 mate-face area 66M, 68M between adjacent stator segments 62 generally along the longitudinal axis T of the axial seal 74A (also illustrated in FIG. 5). That is, the inherent shape of the tab 82 directs the airflow C in a generally non-perpendicular direction relative to the axial seal 74A and along the mate-face areas 66M, 68M for a relatively longer time period before the airflow C exits into the hot gas core airflow path to thereby facilitate cooling between adjacent stator segments 62. The tab 82 directs the airflow more specifically than a conventional drill hole which although simpler geometry wise, expels cooling air therefrom in a trajectory that is perpendicular to the seal. In other words, directly into the hot gas core airflow with a minimal dwell time along the mate-face areas 66M, 68M.

Figure 6:
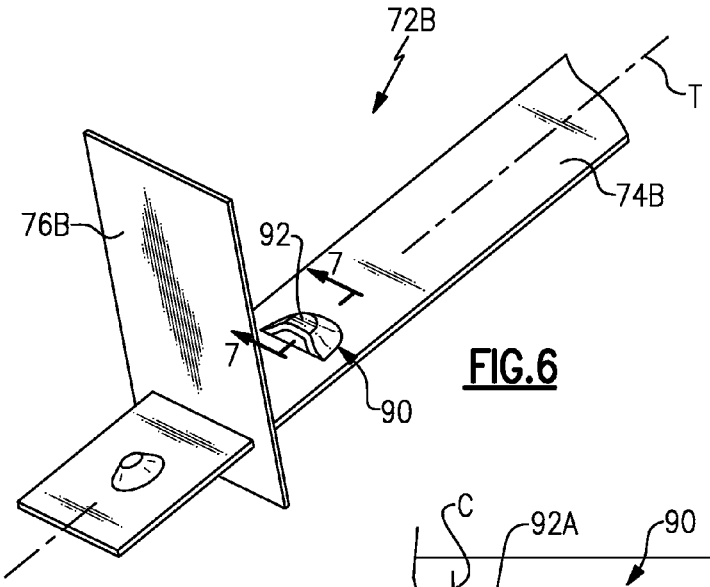
FIG. 6 is an enlarged perspective view of another non-limiting embodiment of a feather seal assembly.
Figure 7:
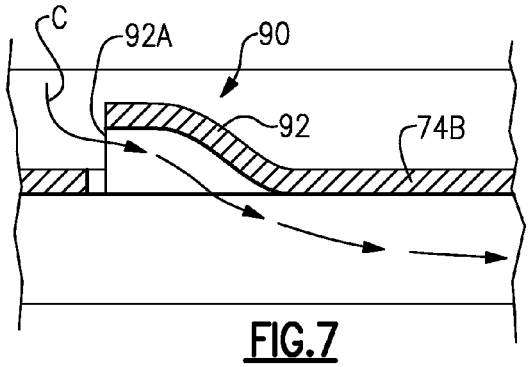
FIG. 7 is a sectional view of taken along line 7-7 in FIG. 6.

With reference to FIG. 6, another non-limiting embodiment of a feather seal assembly 72B includes a directional passage 90 formed along the longitudinal axis T of the axial seal 74B. The directional passage 90 includes a louver 92 to facilitate mate-face area 66M, 68M cooling through direction of cooling air C through the louver 92 (FIGS. 7 and 8).

Figure 8:
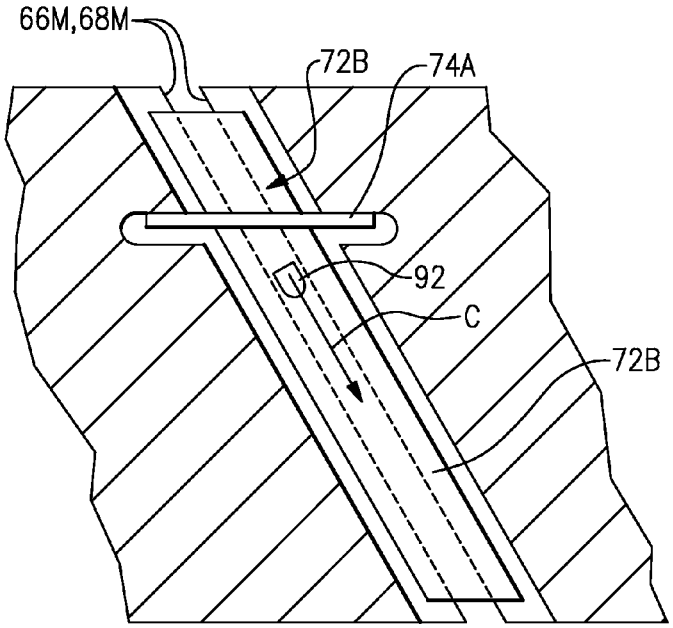
FIG. 8 is a bottom view of the feather seal assembly of FIG. 6 illustrating a cooling flow path therethrough.

The louver 92 also directs air that enters the mate-face areas 66M, 68M through an opening 92A directed generally along the longitudinal axis T of the axial seal 74B as schematically illustrate by arrow C (FIG. 8). That is, the shape of the louver 92 is essentially a scoop that direct the air along the mate-face area 66M, 68M.

Figure 9:
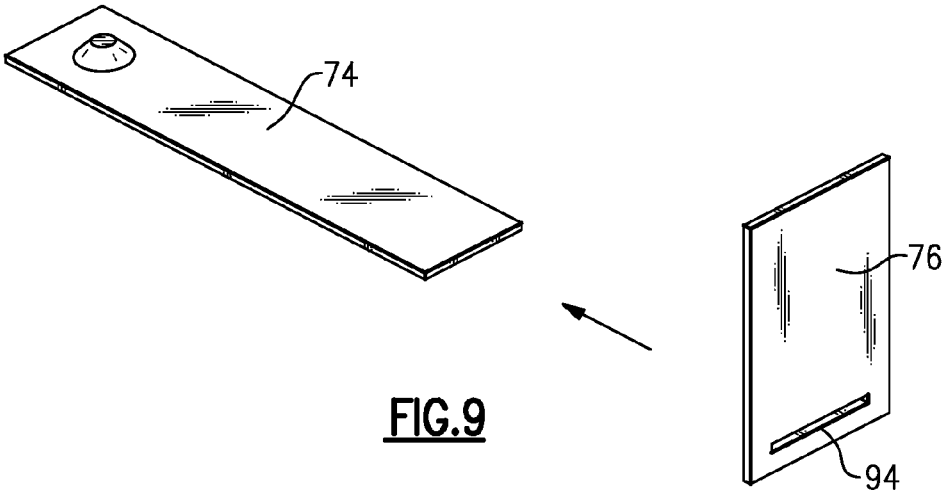
FIG. 9 is an exploded view one non-limiting embodiment of a feather seal assembly having a radial seal and an axial seal.
Figure 10:
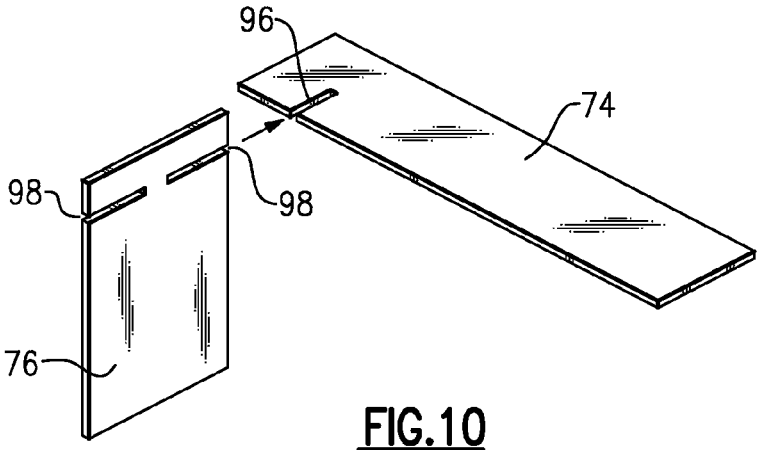
FIG. 10 is an exploded view of another non-limiting embodiment of a feather seal assembly having a radial seal and an axial seal.

The directional passage 90 may also facilitate the retention of the radial seal 76B as discussed above. Alternatively, or in addition thereto, various conventional retention arrangements may be provided for retention of the radial seal 76B to the axial seal 74B. For example, the radial seal 76 may include a complete slot 94 (FIG. 9) in the axial seal 74 to receive the axial seal 74 for retention with a conventional weld. Alternatively, a partial slot 96 in the axial seal 74 is joined with a partial slot 98 in the radial seal 76 for retention with a weld (FIG. 10). Alternatively, the directional passage 90 is formed after assembly of the axial seal 74B and the radial seal 76B to provide an assembly which may not need to be welded. It should be understood that various other retention arrangements may be utilized with the directional passage 90 which may or may not utilize the directional passage 90 as part of assembly retention.

Figure 11:
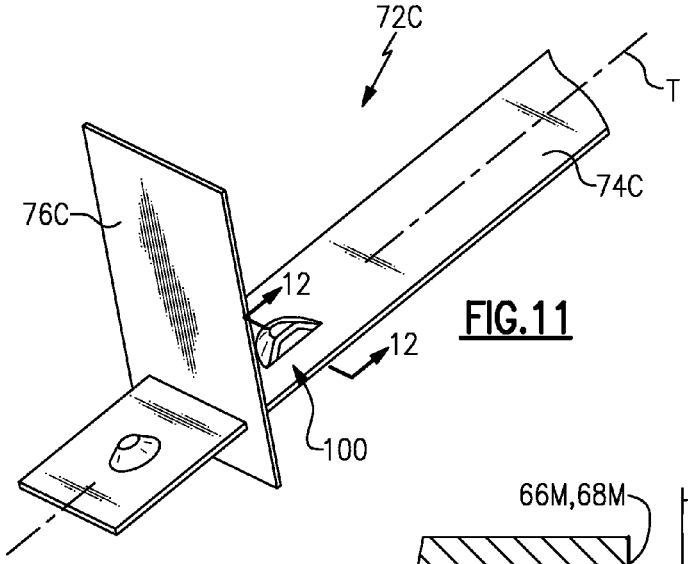
FIG. 11 is an enlarged perspective view of another non-limiting embodiment of a feather seal assembly.
Figure 12:
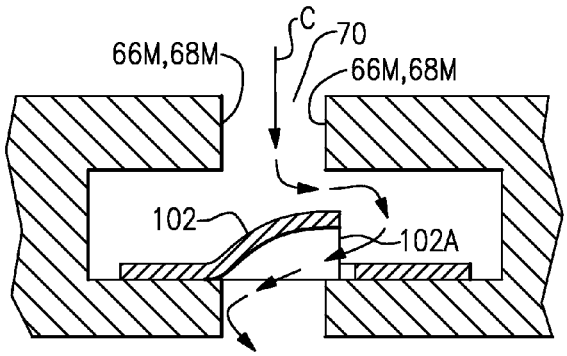
FIG. 12 is a sectional view of taken along line 12-12 in FIG. 11.

With reference to FIG. 11, another non-limiting embodiment of a feather seal assembly 72C includes a directional passage 100 formed along the longitudinal axis T of the axial seal 74C. The directional passage 100 includes a louver 102 to retain the radial seal 76C as discussed above either through a weld, formation of the louver 102 after assembly, or other assembly operation (FIGS. 9, 10) which may or may not utilize the louver 102 as part of assembly retention. Although conventional welding of the radial seal 76C to the axial seal 74C requires an additional operation, the axial seal 74C may then be stamped or otherwise formed in a single operation. It should be understood that various other retention arrangements may be utilized.

Figure 13:
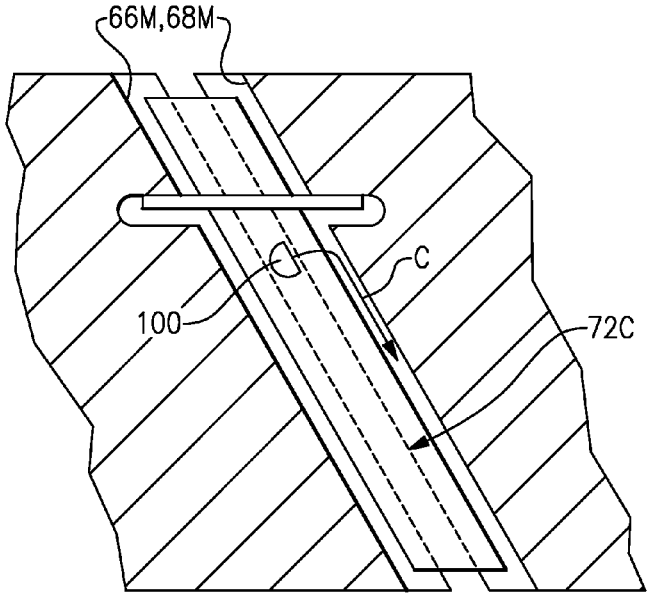
FIG. 13 is a bottom view of the feather seal assembly of FIG. 11 illustrating a cooling flow path therethrough.

The louver 102 directs airflow that enters the mate-face areas 66M, 68M between adjacent segments 62 through an opening 102A generally transverse to the longitudinal axis T of the axial seal 74C as schematically illustrate by arrow C (FIG. 13). The louver 102 directs air transverse to the longitudinal axis T directly toward a desired mate-face area 66M, 68M. That is, the shape of the louver 102 directs air primarily against one side of the mate-face areas 66M, 68M to more directly cool that mate-face area 66M, 68M through impingement. In the disclosed non-limiting embodiment, the opening 102A is directed radially toward, for example, the side of the mate-face areas 66M, 68M which require additional cooling airflow due to, for example, the rotational direction of the turbine section 28.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present invention.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the invention may be practiced other than as specifically described. For that reason the appended claims should be studied to determine true scope and content.

What is claimed:

1. A feather seal assembly comprising:

an axial seal having a directional passage to direct an airflow generally non-perpendicular to said seal, wherein said directional passage defines a tab along a longitudinal axis of said axial seal; and a radial seal mounted to said axial seal transverse thereto, said radial seal at least partially retained by said tab, wherein said tab flexes to receive said radial seal thereover.

2. The feather seal assembly as recited in claim 1, wherein said radial seal is trapped between said tab and a raised feature.

3. The feather seal assembly as recited in claim 1, wherein said directional passage defines a louver.

4. The feather seal assembly as recited in claim 1, wherein said seal is an axial seal and said directional passage defines an opening along a longitudinal axis of said axial seal.

5. The feather seal assembly as recited in claim 1, wherein said directional passage defines an opening transverse to a longitudinal axis of said axial seal.

6. The feather seal assembly as recited in claim 1, wherein the directional passage provided by the axial seal is configured to be positioned entirely between opposing matefaces of platforms having slots that receive the feather seal.

7. A feather seal assembly comprising:

an axial seal having a directional passage and a raised feature; and a radial seal mounted to said axial seal between said directional passage and said raised feature, wherein said directional passage defines a tab along a longitudinal axis of said axial seal, said tab flexes to receive said radial seal thereover.

8. The feather seal assembly as recited in claim 7, wherein said axial seal and said radial seal are mounted between a turbine stator segment.

9. The feather seal assembly as recited in claim 7, wherein said directional passage is configured to be positioned circumferentially between adjacent stator segments.

10. A method of cooling a mate-face area between stator segments of an annular vane ring structure within a gas turbine engine comprising:

directing an airflow generally non-perpendicular to a seal of a feather seal assembly located between a first stator segment and a second stator segment; and directing the airflow through a directional passage that defines a tab that traps a radial seal to the seal, the tab flexing to receive said radial seal thereover.

11. The method as recited in claim 10, further comprising:

directing the airflow along a longitudinal axis of the seal and along the mate-face area.

12. The method as recited in claim 10, further comprising:

directing the airflow transverse to a longitudinal axis of the seal and toward the first stator segment.

* * * * *